United States Patent [19]

Yajima et al.

[11] 4,343,260

[45] Aug. 10, 1982

[54] APPARATUS FOR APPLYING LIQUID STATE MATERIAL ONTO A SURFACE OF A CLOTH OR THE LIKE

[75] Inventors: Mikiharu Yajima; Masuki Masumiya; Sadao Obe, all of Itami, Japan

[73] Assignees: Nitto Boseki Co., Ltd.; Nittobo Itamikako Co., Ltd., both of Japan

[21] Appl. No.: 212,530

[22] Filed: Dec. 3, 1980

[30] Foreign Application Priority Data

Dec. 4, 1979 [JP] Japan ..... 54-168561[U]

[51] Int. Cl.[3] ..... B05C 1/08

[52] U.S. Cl. ..... 118/204; 118/249; 118/258; 118/261

[58] Field of Search ..... 118/258, 259, 249, 212, 118/261, 204; 101/366

[56] References Cited

U.S. PATENT DOCUMENTS

| | | | |
|---|---|---|---|
| 1,849,938 | 3/1932 | Lewis | 118/261 X |
| 3,568,636 | 3/1971 | Lockwood | 118/259 |
| 3,991,708 | 11/1976 | Huebschmann et al. | 118/258 X |

*Primary Examiner*—John P. McIntosh

*Attorney, Agent, or Firm*—Gerald J. Ferguson, Jr.; Joseph J. Baker

[57] ABSTRACT

Apparatus for applying a liquid to a cloth or the like including a stamp roll having a peripheral surface provided with a pattern of pits. A rubbing block, having at least one material supply passage extending vertically therethrough, is disposed above the stamp roll in such a way that a lower rubbing surface of the block is in sliding contact with the peripheral surface of the roll. A supply container is connected to the material supply passage of the rubbing block for supplying the liquid through the block to the peripheral surface of the stamp roll. A pressure roll is disposed below the stamp roll in abutting relation thereto to carry the cloth into intimate contact with the peripheral surface of the stamp roll. The rubbing surface of the block is formed in the downstream side of the material supply passage with a plurality of parallel recesses extending orthogonally to the rotating direction of the roll where a portion of the downstream side rubbing surface is disposed between the material supply passage and the plurality of parallel recesses.

4 Claims, 4 Drawing Figures

APPARATUS FOR APPLYING LIQUID STATE MATERIAL ONTO A SURFACE OF A CLOTH OR THE LIKE

BACKGROUND OF THE INVENTION

This invention relates to an apparatus for applying a liquid state material onto a surface of a cloth or the like.

It has been known that it is very difficult to apply a material in liquid state, such systhetic resin, dyestuff or adhesive, onto the surface of the cloth or the like to uniformily and continuously paint the cloth by supplying the liquid material at a constant rate.

SUMMARY OF THE INVENTION

An object of the present invention is to provide an apparatus for applying a liquid state material onto a surface of a cloth or the like by which the liquid can be uniformly and continuously applied in dot pattern regardless of the viscosity of the liquid.

DETAILED DESCRIPTION OF THE PREFERRED EMBODIMENT

Figure 1:
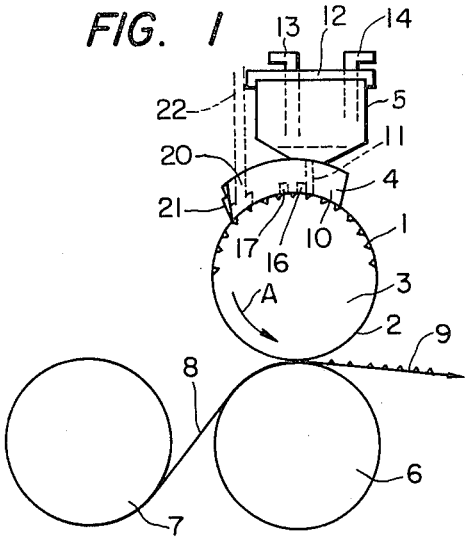
FIG. 1 is a side view of an enbodiment of the apparatus according to the present invention.

In FIG. 1, a stamp roll 3 has a peripheral surface 2 which is formed throughout thereof with a pattern of a member of pits 1. A rubbing block 4 is disposed on the perpheral surface 2 of the stamp roll 3 in a slidable plane contact therewith.

A material in liquid state is supplied from a supply container 5 to the rubbing block 4 through which the liquid material is fed into the individual pits 1 along with a rotation of the stamp roll 3 in a direction shown by an arrow A.

A pressure roll 6 is disposed below the stamp roll 3 with an upper peripheral surface portion of the pressure roll 6 being in pressure contact with the peripheral surface 2 of the stamp roll 3.

An elongated cloth 8 which has been heated by a heating roll 7 is fed continuously into between the stamp roll 3 and the pressure roll 6, as a result of which a pattern of uniformly distributed pits 1 is transferred by means of the liquid material in the pits 1 onto a surface 9 of the cloth 8 continuouly with the rotation of the stamp roll 3.

The shape and size of each pit 1 and the number of the pits 1 on the peripheral surface 2 of the stamp roll 3 depend on the purpose of applying the liquid material onto the cloth surface and the liquid material and cloth material to be used.

Figure 2:
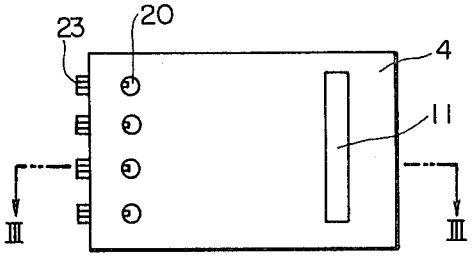
FIG. 2 is a plane rview of a rubbing block used in the apparatus in FIG. 1.
Figure 3:
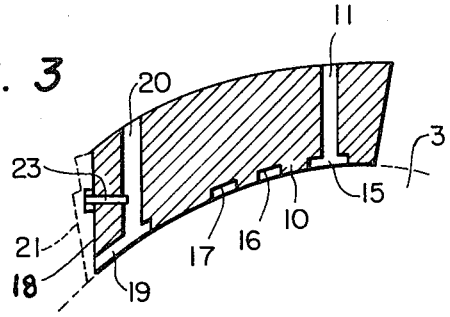
FIG. 3 is a cross sectional view of the rubbing block, taken along a line III–IV in FIG. 2.
Figure 4:
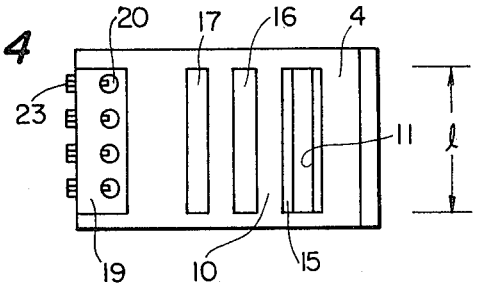
FIG. 4 is a bottom view of the rubbing block according to the present invention.

The rubbing block 4 is constituted such as shown in FIGS. 2 to 4, in which FIG. 2 shows a plan view thereof, FIG. 3 is a cross sectional view of the block taken along a line III—III in FIG. 2 and FIG. 4 is a bottom view of the rubbing block 4. At least a rubbing plane portion 10 of the rubbing block 4 which is to be in slidable contact with the peripheral surface 2 of the stamp roll 3 is formed of an abrasion-resistive synthetic resin such as teflon or nylon so that a good slipping relation is obtained to the peripheral surface 2.

The rubbing block 4 is formed in an upstream end portion thereof along the direction of the arrow A with a liquid supply passage 11 which extends vertically throughout thereof. The lower end opening 15 of the liquid supply passage 11 is enlarged.

The rubbing block 4 is fixed suitably to the liquid supply container 5 so that an upper end opening of the liquid supply passage 11 is held in an intimate contact with a lower discharge port of the supply container 5.

An upper opening of the liquid supply container 5 is air-tightly closed by a cover member 12 through which a liquid supply pipe 13 for feeding the liquid material from a resorvior not shown to the container 5 and an air pipe 14 for supplying a compressed air into the container 5 extend, respectively. The purpose of the provision of the air pipe 14 is to facilitate the feeding of the liquid material through the liquid supply passage 11 of the rubbing block 4 by pushing down the liquid with a compressed air supplied from a suitable air source through the air pipe 14 into the liquid supply container 5, when the viscosity of the liquid material supplied from the supply pipe 13 is very high.

The rubbing plane portion 10 of the rubbing block 4 is further formed in the down stream side of the lower opening 15 of the supply passage 11 with a plurality of parallel recesses 16 and 17 extending in purallel with the lower opening 15 of the supply passage 11.

A plurality of drain passages 20 are also provided in the down stream side of the recesses 16 and 17, which are communicated with each other by a space 19 formed in the rubbing plane portion 10 thereof. The space 19 is opened at a down stream end 18 of the rubbing block 4. A suitable doctor knife 21 is suitably fixed to the down stream end 18 of the rubbing block 4 to close the opened down stream end 18 as shown in FIG. 1 and to scrape an excess amount of the liquid material. The scraped liquid material is accumulated within the space 19 and then recovered through the drain passages 20 and associated reocvery pipes 22 to a resorvior tank etc. not shown.

The cross sectional shape of the recess 16 or 17 is shown as substantial rectangular in FIG. 2. However, it may be any shape such as triangle or semi-circuler.

The opening 15, the recesses 16 and 17 and the space 19 are the same in length, 1, which depends upon the width of the painting area on the running cloth 8.

A regulation bolt 23 is provided for each of the drain passages 20 and threaded into the down stream end 18 so that a top end of the bolt 23 protrudes into the associated passage 20 to regulate the cross sectional area of the passage 20 with the length thereof protruded in the passage 20. The regulation is done according to the viscosity of the liquid material so that the rubbing of the liquid material into the pits 1 on the stamp roll 3 can be done most efficiently.

In the present apparatus having the structure shown in the figures, the liquid material supplied from the resorvior through the supply pipe 13 to the supply container 5 may be directly fed through the supply passage 11 to its opening 15 by gravity when the viscosity of the liquid material is relatively low, or may be fed through the passage 11 to the opening 15 with aid of the pressurized air from the air pipe 14 when the viscosity is relatively high. The viscosity of the liquid material usable in this apparatus may be from about 1 cps to about 1,000,000 cps. It should be noted that although the supply passage 11 is shown as a single passage, it may be possible to use a plurality of parallel passages similarly to the drain passages 20, instead of the single passage 11. The liquid material accumulated in the opening 15 is pushed into the individual pits 1 of the stamp roll 3 and rubbed thereinto by the portion of the rubbing plane 10 between the opening 15 and the recess 16 with the rotation of the stamp roll 3. The liquid material rubbed into the pits 1 is subjected to a shearing force in the area of the recesses 16 and 17 and thus the dinamic viscosity thereof is lowered. Therefore, the individual pits 1 are filled completely with the liquid material.

The excess amount of the liquid material is scraped by the doctor knife 21 and accumulated in the space 19 from which it is recovered through the drain passages 20 and the associated recovery pipe 22 to the resovior as mentioned before.

The liquid material filling completely the individual pits 1 is carried continuously along with the rotation of the stamp roll 3 onto the surface 9 of the cloth 8 carried through the heating roll 7 and pinched between the periphral surfaces of the pressure roll 6 and the stamp roll 3. Therefore, the pattern of the pits on the peripheral surface 2 of the stamp roll 3 is transferred uniformly onto the cloth surface 9, continuously, and fixed thereon.

Without the use of the rubbing block 4 according to the present invention, the amount of liquid material rubbed into each pit 1 may not be uniform, causing nonuniform printing of the cloth 8.

What is claimed is:

1. An apparatus for applying liquid state material onto a surface of a cloth or the like, comprising a stamp roll having a peripheral surface provided with a pattern of pits, a rubbing block having at least one material supplying passage extending vertically therethrough, said rubbing block being disposed above said stamp roll in such a way that a lower rubbing surface of said rubbing block is in sliding contact with said peripheral surface of said stamp roll, a supply container connected to said material supply passage of said rubbing block for supplying the material in liquid state through said rubbing block to said peripheral surface of said stamp roll, and a pressure roll disposed below said stamp roll in abutting relation thereto to carry the cloth in intimate contact with said peripheral surface of said stamp roll, said rubbing surface of said rubbing block being formed in the down stream side of said material supply passage of said rubbing block with a plurality of parallel recesses extending orthogonally to the rotating direction of said stamp roll where a portion of said downstream side rubbing surface is disposed between the material supply passage and said plurality of parallel recesses.

2. An apparatus as in claim 1 where said rubbing block includes a downstream end with a further recess being formed in the lower rubbing surface of the rubbing block; the further recess opening into the downstream end of the rubbing block and where said apparatus includes a doctor means attached to the downstream end of the rubbing block to close the opening where the further recess opens into the downstream end of the rubbing block, said doctor means scraping excess liquid material from the stamp roll.

3. An apparatus as in claim 2 including at least one drain passage extending through the rubbing block into the said further recess.

4. An apparatus as in claim 3 including means for regulating the cross-sectional area of said drain passage.

* * * * *